United States Patent [19]

Yokoyama et al.

[11] Patent Number: 4,960,078

[45] Date of Patent: Oct. 2, 1990

[54] PULSE COMBUSTION DEVICE

[75] Inventors: Nobuyoshi Yokoyama; Susumu Ejiri, both of Toyoake, Japan

[73] Assignee: Paloma Kogyo Kabushiki Kaisha, Nagoya, Japan

[21] Appl. No.: 434,995

[22] Filed: Nov. 9, 1989

[30] Foreign Application Priority Data

Nov. 10, 1988 [JP] Japan ..... 63-284664

[51] Int. Cl.[5] ..... F22B 31/00

[52] U.S. Cl. ..... 122/24; 431/1

[58] Field of Search ..... 122/24; 431/1; 60/247

[56] References Cited

U.S. PATENT DOCUMENTS

| | | | |
|---|---|---|---|
| 3,267,985 | 8/1966 | Kitchen . | |
| 3,447,878 | 6/1969 | Haag et al. | 431/1 |
| 4,568,264 | 2/1986 | Mullen et al. | 431/1 |
| 4,759,312 | 7/1988 | Pletzer | 122/24 |
| 4,884,963 | 12/1989 | Kardos | 122/24 X |

FOREIGN PATENT DOCUMENTS 55-102804 8/1980 Japan .

*Primary Examiner*—Edward G. Favors

*Attorney, Agent, or Firm*—Berman, Aisenberg & Platt

[57] ABSTRACT

A pulse combustion device adapted for use in a liquid heating apparatus. The combustion device includes a combustion chamber having a forward end wall formed with an inlet port to be supplied with a mixture of gaseous fuel and air, an attachment plate unitedly provided with the forward end wall of the combustion chamber for engagement with a liquid vessel of the heating apparatus, a cylindrical decoupler arranged coaxially with the combustion chamber at its rear side, a plurality of tailpipes connected at their one ends to the combustion chamber and at their other ends to a front end of the decoupler, the tailpipes being arranged at their intermediate portions in parallel along the outer circumference of the decoupler, and an exhaust pipe connected at its one end to a rear portion of the decoupler and being extended forwardly along the circumference of the decoupler, said exhaust pipe being further extended forwardly through the attachment plate.

6 Claims, 3 Drawing Sheets

PULSE COMBUSTION DEVICE

BACKGROUND OF THE INVENTION

1. Field of the Invention

The present invention relates to a pulse combustion device, and more particularly to a pulse combustion device adapted for use in a liquid heating apparatus such as a water heater of the storage type, a deep fat flyer or the like.

2. Description of the Prior Art

In Japanese Patent Early Publication No. 55-102804, there has been proposed a pulse combustion device adapted for use in a heat preserving boiler, wherein a combustion chamber is mounted within an upper portion of an upright closed water vessel, and wherein a plurality of spiral tailpipes are connected to the combustion chamber and extended downwardly to heat the water stored in the vessel. The tailpipes are further extended outwardly from a bottom portion of the vessel in a liquid-tight manner. Since the pulse combustion device has to be fixedly mounted to the upper and bottom portions of the vessel, plenty of time is consumed for mounting and removal of the combustion device to and from the vessel. In application of the pulse combustion device to the heat preserving boiler, scale containing various salt of calcium, magnesium and the like and hydrooxide adhered to the tailpipes falls and precipitates on the bottom of the water vessel. If the tailpipes are partly covered with such precipitated scale, heat transfer of the tailpipes will be deteriorated to cause overheat of the tailpipes and cracks in the welded portions of the combustion device. If the precipitated scale is not removed from the water vessel because of the difficulty in removal of the combustion device, the above problems will occur. In the case that the pulse combustion device is arranged in the upper portion of the water vessel to avoid the problems, the temperature of hot water discharged from the vessel in continuous use will drop immediately due to the cold water in the lower portion of the vessel.

SUMMARY OF THE INVENTION

It is, therefore, a primary object of the present invention to provide an improved pulse combustion device which can be mounted to and removed from a liquid vessel in a simple manner to facilitate maintenance and inspection of the combustion device.

According to the present invention, there is provided a pulse combustion device adapted for use in a liquid heating apparatus which comprises a combustion chamber having a forward end wall formed with an inlet port to be supplied with a mixture of gaseous fuel and air, a radially outwardly extending attachment plate unitedly provided with the forward end wall of the combustion chamber for engagement with a liquid vessel of the heating apparatus, a cylindrical tailpipes connected at their one ends to the combustion chamber for open communication with the interior of the combustion chamber and at their other ends to a front end of the decoupler for open communication with the interior of the decoupler, the tailpipes being arranged at their intermediate portions in parallel along the outer circumference of the decoupler, and an exhaust pipe connected at one end thereof to a rear portion of the decoupler and being extended forwardly along the outer circumference of the decoupler, the exhaust pipe being further extended forwardly through the attachment plate.

During assembly of the pulse combustion device with the heating apparatus, the combustion chamber, decoupler, tailpipes and exhaust pipe are inserted into the interior of the liquid vessel through an opening formed in a lower portion of the vessel. Thereafter, the attachment plate is engaged with the lower portion of the vessel and is detachably secured in place. When an amount of scale has precipitated on the bottom of the vessel, the pulse combustion device can be removed from the vessel by removal of the attachment plate to eliminate the scale adhered to the tailpipes.

BRIEF DESCRIPTION OF THE DRAWINGS

Other objects, features and advantages of the present invention will be more readily appreciated from the following detailed description of preferred embodiments thereof when considered with reference to the accompanying drawings, in which.

DESCRIPTION OF THE PREFERRED EMBODIMENTS

Figure 1:
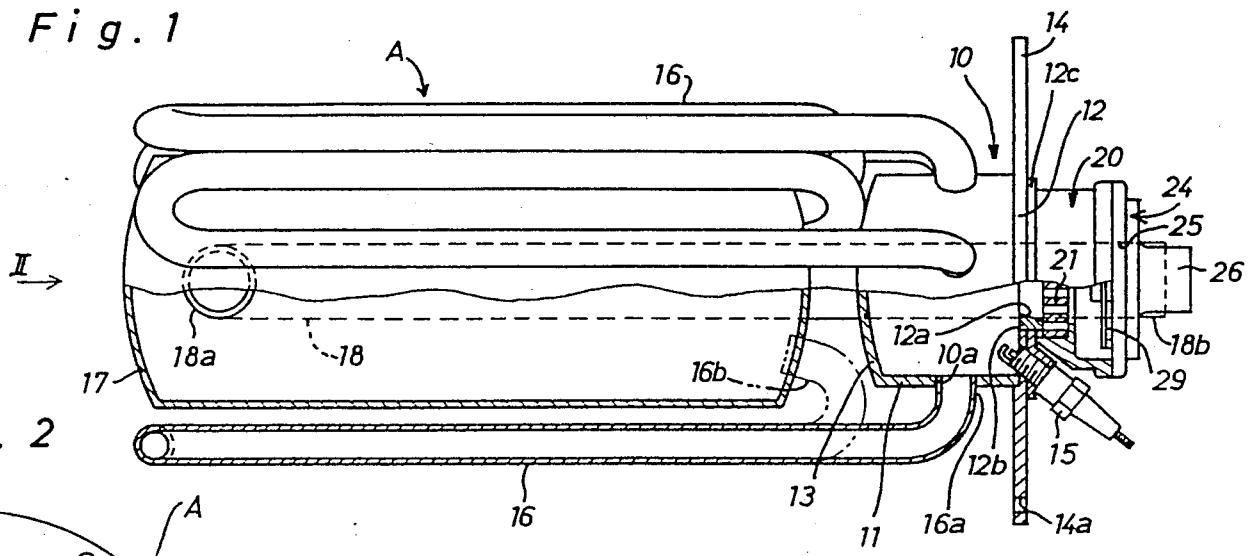
FIG. 1 is a partly sectioned side view of a pulse combustion device in accordance with the present invention.
Figure 2:
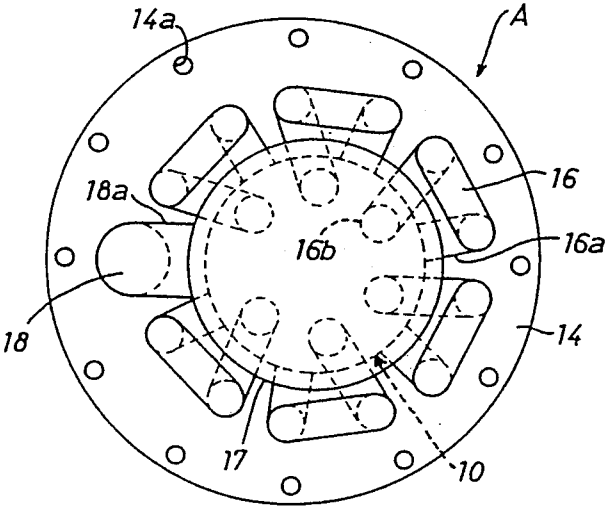
FIG. 2 is a rear view of the pulse combustion device illustrated in a direction shown by an arrow II in FIG. 1.

Disclosed in FIGS. 1 and 2 of the drawings is a pulse combustion device A in accordance with the present invention, which comprises, as main component parts thereof, a combustion chamber 10 unitedly constructed by welding the component parts thereof, a plurality of tailpipes 16, a cylindrical decoupler 17, an exhaust pipe 18, an air-fuel mixer head 20 mounted to an inlet of the combustion chamber 10, and a valve assembly 24 mounted to the air-fuel mixer head 20. As shown in FIG. 1, the combustion chamber 10 has a cylindrical wall 11 and forward and rearward end walls 12 and 13 welded to the opposite ends of cylindrical wall 11. The forward end wall 12 is reinforced by a reinforcement plate **12*c* welded thereto and is integrally formed with a circular attachment plate 14. A burner head 12*b* is securedly coupled with central apertures of the forward end wall 12 and reinforcement plate 12*c* and has a tapered inlet port 12*a* formed therein coaxially with the cylindrical wall 11 of combustion chamber 10. A spark plug 15 is threaded into the forward end wall 12 through the reinforcement plate 12*c* at an inclined angle and has an electrode located in the combustion chamber 10. As shown in FIG. 2, the attachment plate 14 is formed at its outer periphery with a plurality of circumferentially equally spaced mounting holes 14*a* for attachment with an upright closed water vessel 30 shown in FIG. 3**.

The combustion chamber 10 is formed at its cylindrical wall 11 with a plurality of circumferentially equally spaced radial exhaust ports **10*a* which are located respectively in a position displaced in a slight distance from the center of combustion chamber 10 in an axial direction toward the inlet port 12*a*. The plurality of tailpipes 16 are radially inwardly bent at their one ends and welded to the exhaust ports 10***a* of combustion chamber 10. The tailpipes 16 are extended rearwardly from the exhaust ports 10*a* in parallel along the outer circumference of cylindrical decoupler 17 and turned forwardly at their intermediate portions. The cylindrical decoupler 17 is closed at its opposite ends and arranged coaxially with the combustion chamber 10. The tailpipes 16 are radially inwardly bent at their other ends and welded to a front end wall of decoupler 17 for communication with the interior of decoupler 17.

The exhaust pipe 18 is radially inwardly bent at its one end 18*a* and welded to a rear portion of decoupler 17 for communication with the interior of decoupler 17. The exhaust pipe 18 is extended forwardly along the outer circumference of decoupler 17 and arranged between the two parallel tailpipes 16 adjacent thereto as shown in FIG. 2. The other end 18*b* of exhaust pipe 18 is extended outwardly through the attachment plate 14 and welded at its intermediate portion to the attachment plate 14 in a liquid-tight manner. The decoupler 17 has an expansion chamber of large capacity formed therein for stabilizing pulse combustion of the mixture in the combustion chamber 10 and for absorbing combustion noises applied thereto. The decoupler 17 is horizontally supported on the attachment plate 14 by means of the tailpipes 16 and exhaust pipe 18.

As shown in FIG. 1, the air-fuel mixer head 20 is secured to the forward end wall 12 of combustion chamber 10 through the reinforcement plate 12*c* by means of fastening bolts (not shown), and a perforated flame trap 21 is retained in place between the burner head 12*b* and the mixer head 20. Thus, the air-fuel mixer head 20 is communicated with the interior of combustion chamber 10 through the flame trap 21 and burner head 12*b*. The valve assembly 24 includes an annular flange member 25 secured to the open end of mixer head 20 in a fluid-tight manner, and a cylindrical member 26 welded in the center of flange member 25 to form therein a gas passage in open communication with the interior of mixer head 20. The flange member 25 is formed with a plurality of circumferentially equally spaced openings (not shown) in surrounding relationship with the gas passage in cylindrical member 26. The cylindrical member 26 is provided therein with a flapper-type gas inlet valve unit (not shown) which is arranged to permit inward flow of gaseous fuel supplied therethrough into the mixer head 20 and to block outward flow of fuel-air mixture from the mixer head 20. In the mixer head 20, an annular deflector plate 29 is mounted to the flange member 25 to permit inward flow of fresh air supplied therethrough into the mixer head 20 and to block outward flow of the fuel-air mixture from the mixer head 20.

Figure 3:
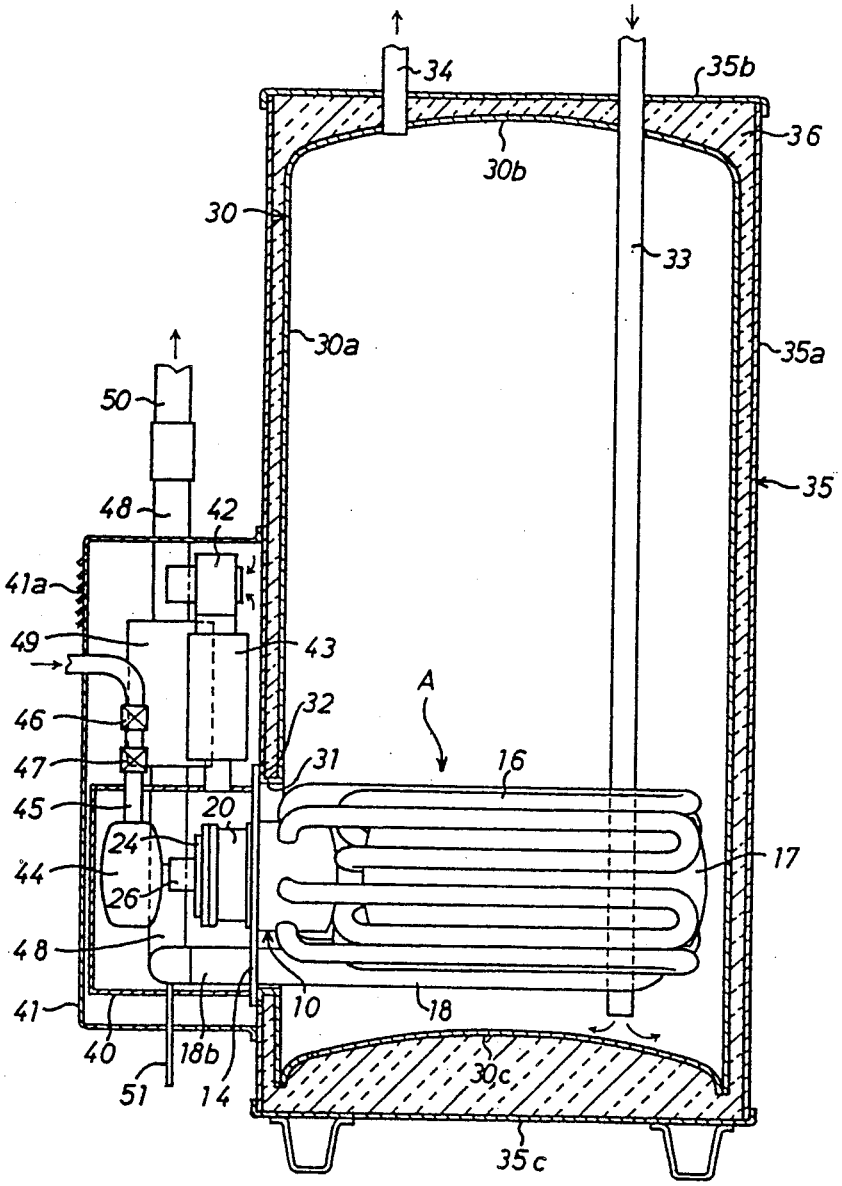
FIG. 3 is a sectional view of a water heater of the storage type equipped with the pulse combustion device shown in FIGS. 1 and 2.

Illustrated in FIG. 3 is an upright water heater of the storage type equipped with the pulse combustion device A. The water vessel 30 of the heater is composed of a cylindrical inner casing 30*a* closed at its upper and bottom ends by means of plates 30*b* and 30*c* welded thereto. A cylindrical support member 31 is welded to a lower portion of the cylindrical inner casing 30*a* to form a circular opening the inner diameter of which is determined to allow insertion of the combustion chamber 10, tailpipes 16, decoupler 17 and exhaust pipe 18 of pulse combustion device A into the interior of upright water vessel 30. The cylindrical support member 31 has an annular flange 32 for engagement with the attachment plate 14 of pulse combustion device A. The upright water vessel 30 is housed in a cylindrical outer casing 35 which has a cylindrical wall 35*a* closed at its upper and bottom ends by means of plates 35*b* and 35*c* welded thereto. A space between the upright water vessel 30 and the outer casing 35 is filled with heat insulation material 36. Thus, the upright water vessel 30 is exposed to the exterior only at the annular flange 32 of cylindrical support member 31. A water supply pipe 33 is inserted into the interior of vessel 30 in a liquid-tight manner and extended upwardly through the upper plate 30*b*, insulation material 36 and upper plate 35*b*. The water supply pipe 33 has an opening located just above the bottom plate 30*c* of vessel 30. A discharge pipe 34 is connected in a liquid-tight manner to the upper plate 30*b* of vessel 30 for open communication with the interior of vessel 30 and extended upwardly through the insulation material 36 and upper plate 35*b* of casing 35.

When the pulse combustion device A is assembled with the upright water vessel 30, the combustion chamber 10, tailpipes 16, decoupler 17 and exhaust pipe 18 are inserted into the interior of vessel 30 through the circular opening of cylindrical support member 31. Thus, the attachment plate 14 of combustion chamber 10 is engaged with the annular flange 32 of cylindrical support member 31 in a liquid-tight manner and secured in place by means of a plurality of bolts threaded into the annular flange 32 of support member 31 through mounting holes 14*a*. An air chamber casing 40 is secured to the attachment plate 14 of combustion chamber 10 in an air-tight manner to contain therein the mixer head 20 and valve assembly 24. A gas container 44 is connected to the cylindrical member 26 of valve assembly 24 to be supplied with gaseous fuel from a source of gaseous fuel (not shown) through a gas supply conduit 45. The gas supply conduit 45 is provided therein with a primary electromagnetic valve 46 for control of supply of the gaseous fuel from the source of gaseous fuel and a secondary electromagnetic valve 47 for control of the flow quantity of gaseous fuel supplied therethrough into the gas container 44.

The exhaust pipe 18 of pulse combustion device A is connected at its outer end 18*b* to an upwardly extending pipe 48 which is provided at its intermediate portion with an exhaust muffler 49. The upwardly extending pipe 48 is further connected to a flue pipe 50. An electrically operated air blower 42 is connected to the air chamber casing 40 through an air intake muffler 43 to supply fresh air into the interior of air chamber casing 40. A cover casing 41 is coupled with and fixed to the outer casing 35 of the water heater to contain therein the air chamber casing 40, air blower 42, intake muffler 43 and exhaust muffler 49. The cover casing 41 is formed at its upper portion with a plurality of lateral slits 41*a*. A vertical drain pipe 51 is connected to the lower end of exhaust pipe 48 and extended downwardly through the air chamber casing 40 and cover casing 41.

For operation of the pulse combustion device A, the electromagnetic valves 46, 47 in gas supply conduit 45 are opened to supply gaseous fuel into the gas container 44 from the source of gaseous fuel, while the air blower 42 is operated to supply fresh air into the air chamber casing 40 through intake muffler 43. Thus, the mixer head 20 is supplied with the gaseous fuel and air from gas container 44 and casing 40 through the valve assembly 24 to supply a mixture of the gaseous fuel and air into the combustion chamber 10 through the flame trap 21 and inlet port 12*a*. The mixture of gaseous fuel and air from inlet port 12*a* flows rearwardly along the center line of combustion chamber 10 and turns radially outwardly by abutment with the internal surface of rearward end wall 13 to flow forwardly along the internal surface of cylindrical wall 11. Thus, the mixture flows radially inwardly by abutment with the internal surface of forward end wall 12 and is mixed with the incoming mixture to cause a doughnut-like vortex flow of the mixture in the whole interior of combustion chamber 10. In addition, a portion of the mixture flows into the respective tailpipes 16.

On start up, the spark plug 15 is energized for a predetermined period of time, and the vortex flow of mixture causes the incoming mixture to flow toward the electrode of spark plug 15. Thus, the mixture is rapidly ignited by energization of the spark plug 15 without any delay of time. The pressure of the resulting rapid combustion of the mixture closes the gas inlet valve unit and forces the combustion products to exhaust from the tailpipes 16. When resonant combustion is initiated, oscillation takes place in the tailpipes, creating alternate positive and negative pressures in the tailpipes 16. During periods of negative pressure in the combustion chamber 10, the gas inlet valve unit is opened to introduce gaseous fuel into the mixer head 20 from the gas container 44, and fresh air is introduced into the mixer head 20 from the air chamber casing 40. The mixture of fresh gaseous fuel and air is reignited by a flame caused by the resonant combustion.

From the above description, it will be understood that the pulse combustion device A can be mounted to the water heater in a simple manner by engagement with the annular flange 32 of cylindrical support member 31 at its attachment plate 14. Since the tailpipes 16 are arranged in parallel along the cylindrical decoupler 17, the pulse combustion device A can be formed as a whole in a cylindrical configuration. This is useful to form the circular opening of cylindrical support member 31 in a relatively small diameter. In the case that the exhaust pipe 18 is arranged between the two parallel tailpipes 16 adjacent thereto as described above, the circular opening of support member 31 can be formed further smaller in diameter. In the water heater, the combustion chamber 10 and tailpipes 16 of the combustion device A are arranged in the lower portion of the water vessel 30. This is useful to reduce a difference in temperature between the upper and lower portions of the water vessel 30 during operation of the combustion device A. When an amount of scale has precipitated on the bottom of water vessel 30, the pulse combustion device A can be easily removed from the water vessel 30 by removal of the attachment plate 14 to eliminate the scale adhered to the tailpipes 16.

Figure 4:
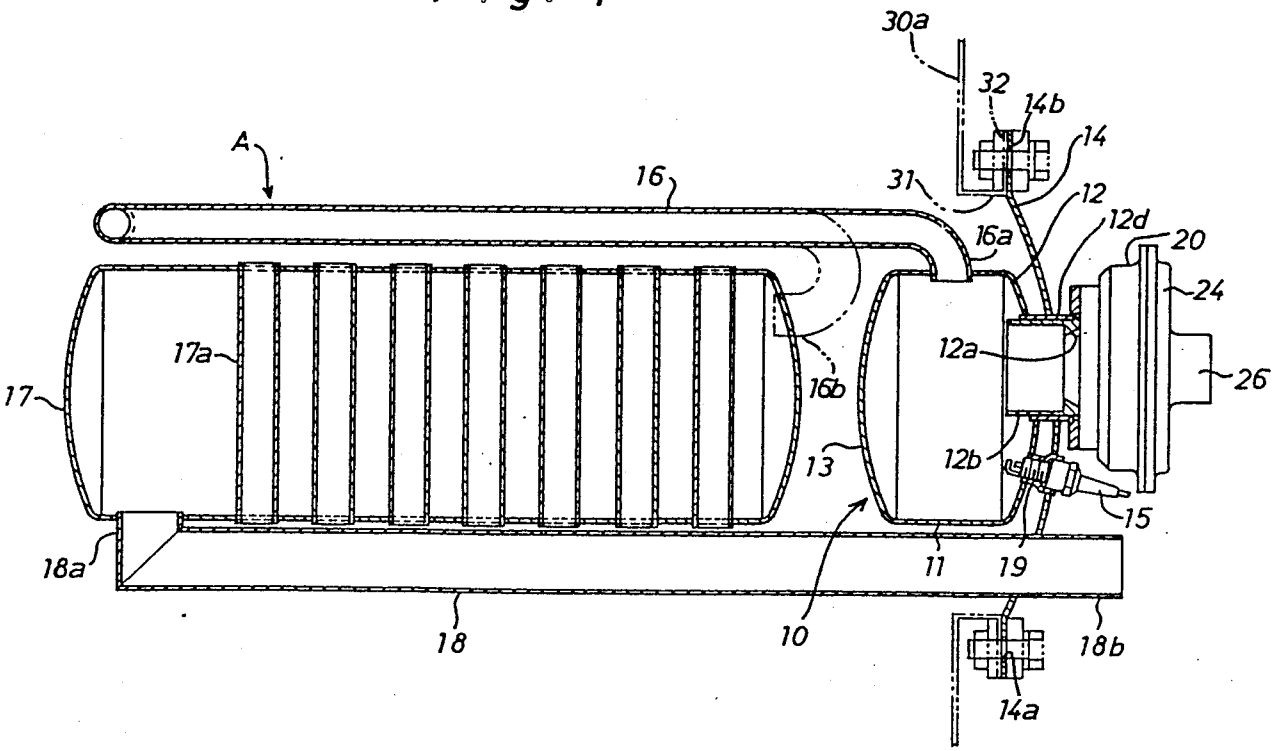
FIG. 4 is a sectional view of a modification of the pulse combustion device shown in FIGS. 1 and 2.

In FIG. 4 there is illustrated a modification of the pulse combustion device A, wherein the forward end wall 12 of combustion chamber 10 is formed in a forwardly protruded semi-spherical configuration and has a short intake duct **12*d* welded thereto. The intake duct 12*d* is formed at its front end with an annular flange for attachment with the mixer head 20. In this modification, the attachment plate 14 is formed also in a forwardly protruded semi-spherical configuration and is separated from the forward end wall 12 of combustion chamber 10. The intake duct 12*d* is extended forwardly through the center of attachment plate 14 and welded at its intermediate portion to the attachment plate 14. The burner head 12*b* is fixedly coupled within the intake duct 12*d*, and the mixer head 20 is secured to the annular flange of intake duct 12*d*. The spark plug 15 is threaded into a tubular boss 19 which is welded to the respective lower portions of forward end wall 12 and attachment plate 14. The attachment plate 14 has an annular portion 14*b* formed with the mounting holes 14*a* for attachment with the annular flange 32 of support member 31 secured to the water vessel 30. The cylindrical decoupler 17 is provided thereon with a plurality of axially spaced heat condution pipes 17*a* to increase the area for heat exchange with the water in vessel 30**.

During operation of the modified pulse combustion device, the water to be heated is introduced into a space between the forward end wall 12 of combustion chamber 10 and the attachment plate 14 to cool the attachment plate 14, intake duct **12*d* and tubular boss 19. This is useful to enhance the durability of the valve assembly 24 and to avoid overheat of the spark plug 15**.

Although the preferred embodiment and modification of the present invention have been shown and described above, it should be understood that various other modifications and rearrangements of the parts may be resorted to without departing from the scope of the invention as disclosed and claimed herein. For example, the deflector plate 29 in the valve assembly 24 may be replaced with a conventional flapper valve unit, and the number of tailpipes 16 may be reduced or increased in necessity.

What is claimed is:

1. A pulse combustion device adapted for use in a liquid heating apparatus, comprising:

a combustion chamber having a forward end wall formed with an inlet port to be supplied with a mixture of gaseous fuel and air;

a radially outwardly extending attachment plate unitedly provided with the forward end wall of said combustion chamber for attachment with a liquid vessel of said heating apparatus;

a cylindrical decoupler arranged coaxially with said combustion chamber at its rear side;

a plurality of tailpipes connected at their one ends to said combustion chamber for open communication with the interior of said combustion chamber and at their other ends to a front end of said cylindrical decoupler for open communication with the interior of said decoupler, said tailpipes being arranged at their intermediate portions in parallel along the outer circumference of said cylindrical decoupler; and an exhaust pipe connected at one end thereof to a rear portion of said decoupler and being extended forwardly along the outer circumference of said decoupler, said exhaust pipe being further extended forwardly through said attachment plate.

2. A pulse combustion device as claimed in claim 1, wherein said attachment plate is a circular plate integrally formed the forward end wall of said combustion chamber.

3. A pulse combustion device as claimed in claim 1, wherein said attachment plate is spaced from the forward end wall of said combustion chamber in a forward direction and connected to said combustion chamber by means of an intake duct forming therein the inlet port.

4. A pulse combustion device as claimed in claim 3, wherein said attachment plate and said forward end wall are each formed in a forwardly protruded semi-spherical configuration.

5. A pulse combustion device as claimed in claim 1, wherein said tailpipes are radially inwardly bent at their one ends and connected to said combustion chamber, said tailpipes being extended rearwardly from said combustion chamber in parallel along the outer circumference of said cylindrical decoupler and turned forwardly at their intermediate portions and being further radially inwardly bent at their other ends and connected to the front end of said decoupler.

6. A pulse combustion device as claimed in claim 5, wherein said exhaust pipe is radially inwardly bent at one end thereof and connected to the rear portion of said decoupler, said exhaust pipe being extended forwardly along the outer circumference of said decoupler and arranged between the two parallel tailpipes adjacent thereto.

* * * * *